US006220157B1

(12) United States Patent
Delwiche et al.

(10) Patent No.: US 6,220,157 B1
(45) Date of Patent: Apr. 24, 2001

(54) PRINTING PRESS WITH IN-LINE CENTRAL IMPRESSION CYLINDERS

(75) Inventors: Christopher Delwiche; Gregory Ginnow; David C. O'Donnell, all of Green Bay; Jon Vander Pas, Menasha, all of WI (US)

(73) Assignee: Paper Converting Machine Company, Green Bay, WI (US)

( * ) Notice: Subject to any disclaimer, the term of this patent is extended or adjusted under 35 U.S.C. 154(b) by 0 days.

(21) Appl. No.: 09/275,138

(22) Filed: Mar. 23, 1999

(51) Int. Cl.[7] ..... B41F 5/16; B41F 5/18; B41F 13/02; B41F 13/56

(52) U.S. Cl. ..... 101/178; 101/179; 101/180; 101/181; 101/220; 101/225

(58) Field of Search ..... 101/174, 175, 101/176, 178, 181, 183, 216, 219, 228, 232, 179, 180, 220, 225

(56) References Cited

U.S. PATENT DOCUMENTS

| | | | | |
|---|---|---|---|---|
| 637,564 | * | 11/1899 | Hett . | |
| 1,847,639 | * | 3/1932 | Barber . | |
| 1,847,708 | * | 3/1932 | Barber . | |
| 1,972,506 | * | 9/1934 | Wood | 270/5 |
| 2,887,312 | * | 5/1959 | Zuckerman | 270/5 |
| 2,911,908 | * | 11/1959 | Johnson | 101/181 |
| 3,013,487 | * | 12/1961 | Faeber | 101/181 |
| 4,909,148 | * | 3/1990 | George | 101/178 |
| 5,083,511 | * | 1/1992 | Hertel et al. | 101/486 |
| 5,239,924 | | 8/1993 | Wallmann et al. . | |
| 5,479,856 | * | 1/1996 | Wirz | 101/177 |
| 5,570,633 | | 11/1996 | Schultz et al. . | |
| 5,660,108 | * | 8/1997 | Pensavecchia | 101/137 |
| 5,706,725 | | 1/1998 | Kolbe et al. . | |

FOREIGN PATENT DOCUMENTS

| | | |
|---|---|---|
| 325 445 | 7/1989 | (EP) . |
| 464 309 | 8/1997 | (EP) . |
| 2 550 995 | 3/1985 | (FR) . |
| 2145663 | 4/1985 | (GB) . |
| 2 283 939 | 5/1995 | (GB) . |

* cited by examiner

*Primary Examiner*—Kimberly Asher

(57) ABSTRACT

A printing press includes a pair of in-line central impression cylinders which rotate about parallel axes. A web which is printed on the central impression cylinders is advanced from one of the cylinders to the other along a path which is perpendicular to the axes. The web is advanced from an unwind to the first central impression cylinder along a path which is parallel to the axes, and the web is advanced from the second central impression cylinder to a rewind along a path which is parallel to the axis. The web path between the central impression cylinders is relatively short, and the printed side of the web does not contact any rolls except possibly a laydown roll before the second impression cylinder. The central impression cylinders and the plate rolls are driven by different servo motors, and a controller controls the servo motors for adjusting the repeat of the printed images.

8 Claims, 11 Drawing Sheets

PRINTING PRESS WITH IN-LINE CENTRAL IMPRESSION CYLINDERS

BACKGROUND OF THE INVENTION

This invention relates to a printing press which includes multiple in-line central impression cylinders or drums and means for obtaining registration of the images which are printed on the cylinders.

Currently, high quality flexographic printing using extensible web materials is done on central impression (CI) presses. The flexographic process offers distinct cost advantages and flexibility compared to other types of printing such as gravure. The advantage of using a CI drum over an in-line flexopress is that the web is stable during the printing process. The stability of the web allows for higher quality printing on a variety of substances including extensible films. Registration error can be maintained to within 0.003 inch between any two colors being printed.

Unfortunately, the number of colors that can be printed on a single CI drum is limited by a number of factors, including:

a) size of the drum (manufacturability of the drum decreases as size increases);

b) the maximum repeat of the plate roll;

c) size of the dryer between the color decks;

d) space required for operator to view the web;

e) access to the decks (i.e. safety hazards exist as operator climbs on the machine);

f) overall height of machine (exceeds ceiling height in some plants). With these considerations, a maximum of 10 colors is realistic, but still troublesome.

Tandem in-line presses have been built before. For example, applicants' assignee Paper Converting Machine Company built a tandem press in 1989 that used two 4 color stations in-line. One of the purposes of the press was to decrease changeover time by running a job on one of the press sections while the other section was changed over to run the next job. once the first job was done, the press that contained the next job would run. The changeover time was decreased, but added cost was incurred by having two press sections when only one press section was required.

Another purpose of the tandem design was to improve operator access by using smaller press sections. However, the resulting compromise, when multiple press sections were required to print, was increased registration error between any two printed colors. The color-to-color registration is normally between 0.015 inch and 0.030 inch, depending upon variables such as machine speed, web material, and dryer temperature. These variables create a number of conditions, including:

a) Deformation of the web caused by heating the web as it travels through a dryer section located between the press sections.

b) Deformation of the web caused by the tension required to transport the web from the first press section to the downstream sections. The web path between press sections is long since the web travels away from the press and into a tunnel dryer before turning back toward the next press section. The longer the web path, the greater the amount of idler roll friction the web needs to overcome or drive, which in turn is proportional to the amount of tension imparted on the web.

c) Transmission errors and backlash in the drive train caused by the pitch variation of the associated gearing.

Further problems with this design included the cost associated with having and supporting two overhead dryer sections (one between press sections and one after the last press section). Furthermore, the machine is quite sensitive to operator adjustments. To obtain the desired print, the operator had to adjust tensions, dryer temperatures, drum temperatures, and registration control parameters. This caused longer make-ready times compared to single CI presses and required highly qualified and trained personnel. Consequently, the limitations in this design resulted in high operating costs.

In virtually all in-line designs, including flexo or gravure, a registration system is used to maintain print registration from one press section to the next. The common method for registration control is to use a web compensation system. A web compensator adjusts the length of the web path and ultimately the tension within the zone between the two press sections. An isolated system furnished by a number of vendors such as Bobst and Eltromat measure the registration error and control the web path length. Problems with this type of system include:

a) Limited compensation. The unit can run out of adjustment stroke when the register error is continually in one direction.

b) Compensation unit takes up space in the machine. The unit must be mounted between the press sections where there is limited physical space.

c) Excessive web wrap around compensator idlers, which requires web to be completely dried or picking of the ink will occur.

d) Operator needs to adjust system to maintain correct responsiveness to the system, especially when material is changed.

e) Operator needs to manually obtain correct registration before registration controller is enabled. Again. this requires highly qualified personnel and takes time.

Another method to control print register is to modify the command to the sectionalized drives with an adjustment based upon the registration error. Depending upon the method used, the tension of the material between the press sections may be affected. Otherwise, the printing cylinders are adjusted by increasing or decreasing their velocity based upon the amount of registration error. This method eliminates some of the challenges associated with a web compensator, but it still has limitations:

a) If registration error is continuous in one direction and if registration is adjusted with tension, extreme tensions (high or low) can be built which can cause web breaks.

b) Operator needs to manually obtain correct registration before registration controller is enabled.

c) Limited accuracy of the registration correction command. The system adjusts the registration by adding a trimming signal to the velocity command of the drives. Errors can occur in the conversion from a position-based signal to a velocity signal.

SUMMARY OF THE INVENTION

The invention increases the color capability of a flexographic or gravure press while maintaining the color-to-color print register associated with high quality flexographic standards. The invention allows printed images that are not multiples of the gear pitch that drives the plate cylinder.

The web path through the press is unique and essential to obtaining a number of design advantages. Instead of having the machine sections in one line, the press sections are turned ninety degrees relative to the upstream and downstream sections of the machine. The printed side of the web coming from the output of the first press section never touches an idler roll while it travels to the second press section. This is a significant advantage because it eliminates the need for a dryer between the two press sections and avoids the possibility of the ink transferring off the web and onto an idler roll. The only time that the printed side of the web contacts another surface of the machine between the press sections is when the web is laid down onto the second CI drum. However, even that contact point can be eliminated.

The invention also minimizes disturbances to the web between the press sections. Design considerations include length of web path, number and design of the idler rolls, design of dryer system, and the tension control system. A key component of the invention is the reduced length of web path between the two press sections compared to previous designs. There is a 50% decrease in web path length between this design and the tandem in-line press previously referred to. Furthermore, the number of rolls between the press sections that are web-driven is minimized. consequently, the invention has a significant effect on minimizing the printed registration error, while exceeding the present limitation of 10 color capability.

DESCRIPTION OF THE DRAWING

The invention will be explained in conjunction with illustrative embodiments shown in the accompanying drawing, in which.

DESCRIPTION OF SPECIFIC EMBODIMENTS

Figure 1:
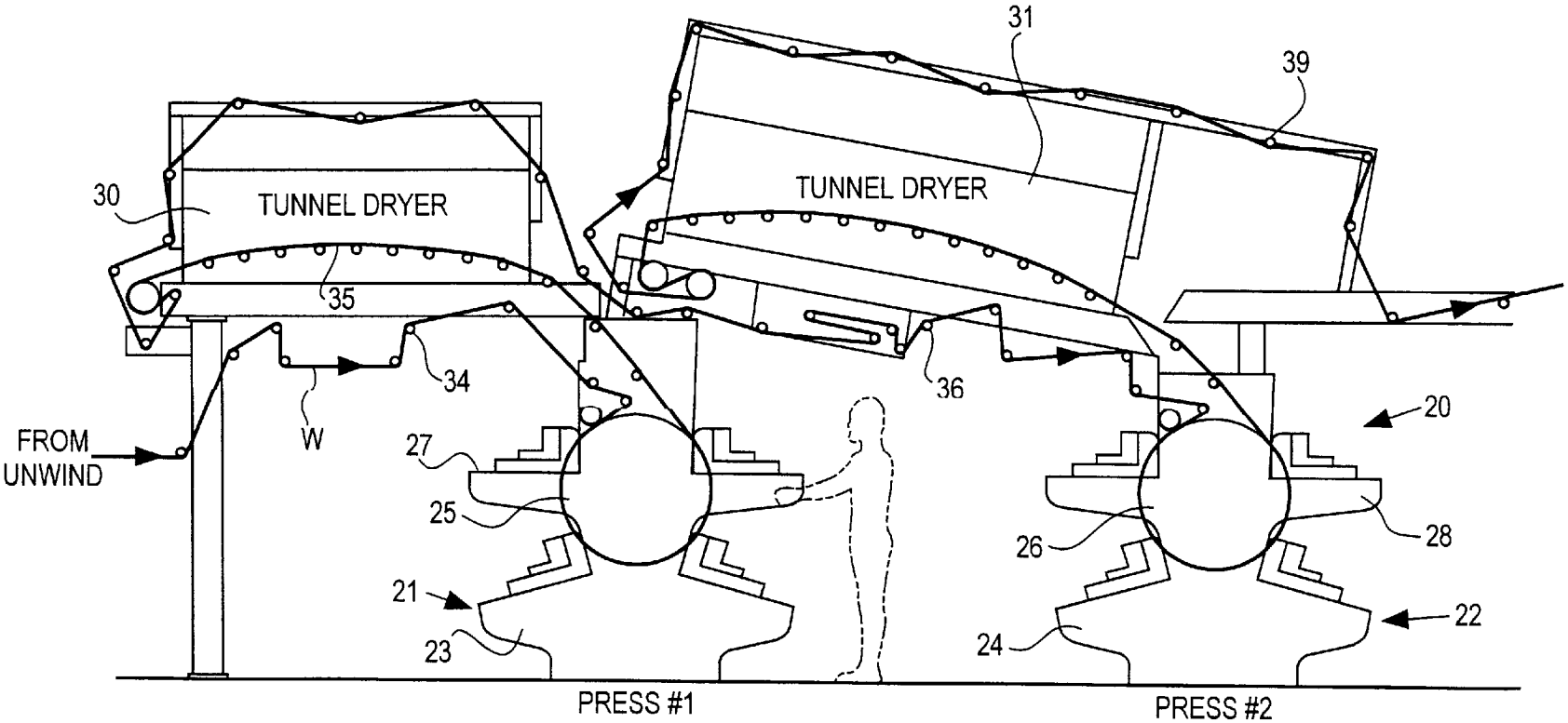
FIG. 1 PRIOR ART
FIG. 1 illustrates a prior art tandem in-line flexographic press.

FIG. 1 illustrates the prior art tandem in-line flexographic press 20 which was made by applicants' assignee Paper Converting Machine Company. First and second press sections 21 and 22 include a pair of side frames 23 and 24 which rotatably support central impression (CI) cylinders or drums 25 and 26. The first press includes four color decks 27, and the second press includes four color decks 28. A conventional plate roll and anilox roll (not shown) are mounted on each color deck.

A first tunnel dryer 30 is mounted above the first press 21, and a second tunnel dryer 31 is mounted above the second press 22. Each press also includes conventional between color dryers (not shown) between the color decks.

A web W travels from an unwind apparatus (to the left of Press No. 1) over idler rolls 34 to the first CI cylinder 25. The web is supported by the rotating CI cylinder while the color decks 27 print the web.

The printed web travels through the first tunnel dryer 30 over idler rolls 35 and is then directed to the Press No. 2 by a series of idler rolls 36. The web may be printed with four additional colors by the color decks 28 of the second press, or the web can be printed with only four colors on one of the presses while the other press is changed over to run the next job.

The web is advanced from the second press through the second tunnel dryer 31 where it is supported by idler rolls 38. The web then moves over idler rolls 39 to a rewind apparatus to the right of Press No. 2.

Figure 2:
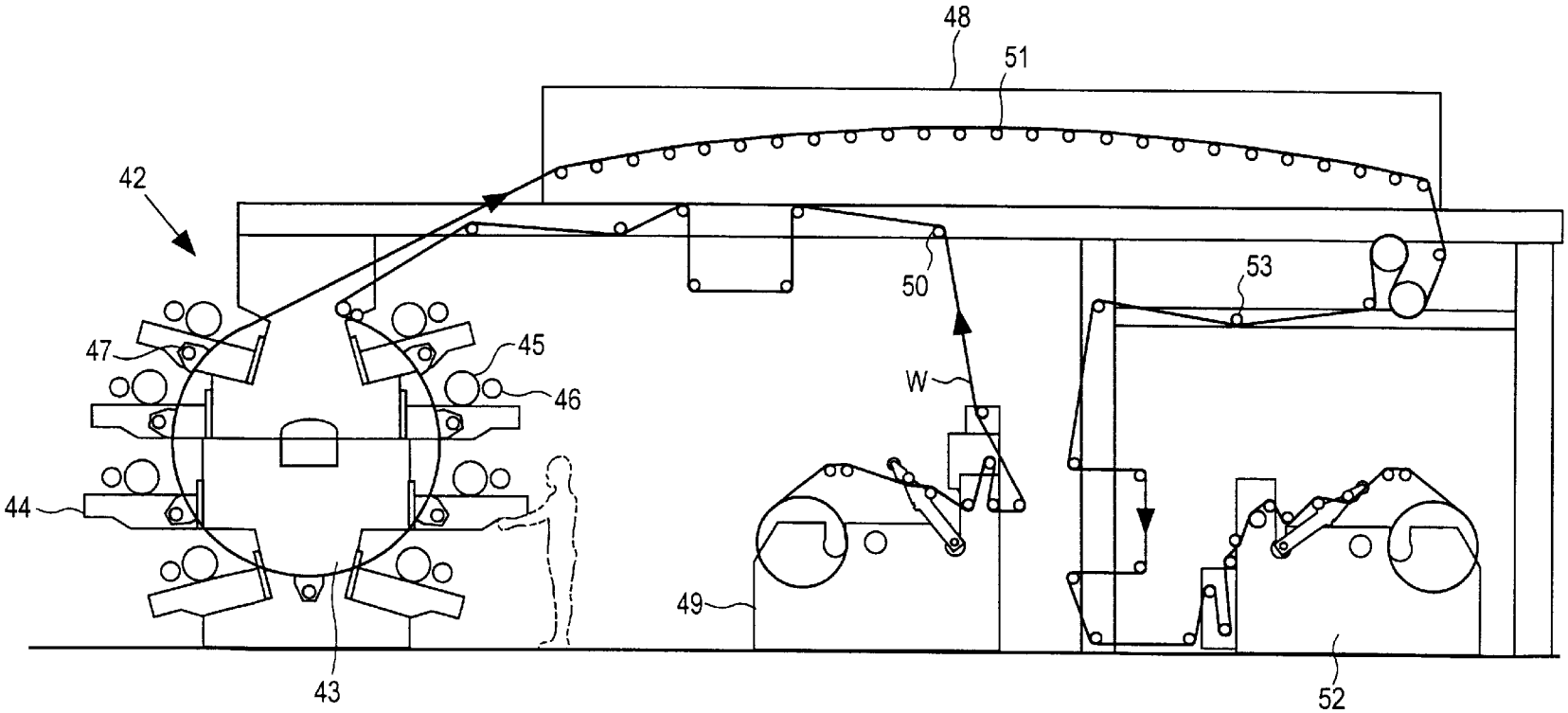
FIG. 2 PRIOR ART
FIGS. 2 illustrates a prior art 8 color CI flexographic press.

FIG. 2 illustrates a prior art wide web eight color CI flexopress 42. The press includes a central impression cylinder 43 and eight color decks 44, each of which includes a plate roll 45 and an anilox roll 46. Seven between color dryers 47 are mounted downstream of the first seven plate rolls, and a tunnel dryer 48 is mounted above the press.

The web W is unwound from an unwind apparatus 49 and travels over idler rolls 50 to the CI cylinder 43. The printed web is advanced through the tunnel dryer 48 over idler rolls 51, and the dried web is directed to a rewind apparatus 52 by idler rolls 53.

Figure 3:
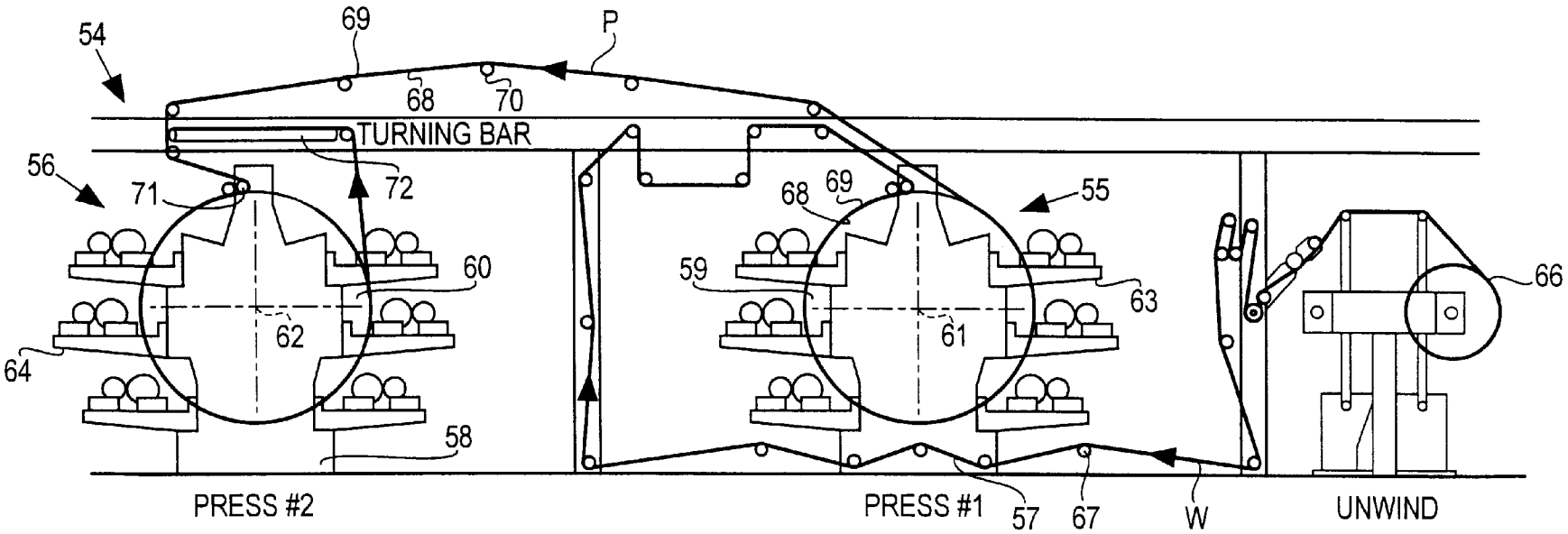
FIG. 3 illustrates a flexographic press formed in accordance with the invention.

FIG. 3 illustrates one embodiment of a flexopress 54 which is formed in accordance with the invention. The press 54 includes two in-line press sections 55 and 56 which include frames 57 and 58 which rotatably support CI cylinders 59 and 60. The CI cylinders rotate on parallel axes 61 and 62. The first press 57 includes six color decks 63, and the second press 58 includes five color decks 64. The plate rolls, anilox rolls, and between color dryers are omitted for clarity of illustration.

The web W is unwound from an unwind apparatus 66 and is directed by idler rolls 67 to the first CI cylinder 59. One side 68 of the web is supported by the CI cylinder, and the other side 69 of the web is printed by the color decks 63. The web moves along a web path P from the first CI cylinder over idler rolls 70 to the second CI cylinder 60. The web path P is perpendicular to the axes of rotation 61 and 62 of the CI cylinders. The idler rolls 70 support the unprinted side 68 of the web, and the printed side 69 does not contact the idler rolls. There is therefore no need for a tunnel dryer between the two CI cylinders.

The length of the web path P between the two press sections is minimized, and only six idler rolls 70 are needed to support the web in the embodiment illustrated in FIG. 3.

Just prior to the second CI cylinder 60 the web travels around laydown roll 71 which directs the web generally tangentially to the CI cylinder. Although the laydown roll 70 contacts the printed side of the web, the ink is sufficiently dry by the time that it reaches the laydown roll that such contact does not adversely affect the printing. Alternatively, a small dryer similar to a between-color-dryer can be positioned just upstream of the laydown roll to ensure that the ink is dry.

The web is printed again by the color decks 64 of the second press. The web is traveling generally vertically upwardly as it leaves the CI cylinder 62, so the sixth color deck on the second press is omitted. The web travels over a turning bar 72 (see also FIG. 5) which turns the web 90° so that it travels in a direction which is perpendicular to the web path P between the in-line press sections and parallel to the axes 61 and 62 of the CI cylinders. A tunnel dryer 74 (FIG. 8) can be positioned downstream from the turning bar 72.

Figure 4:
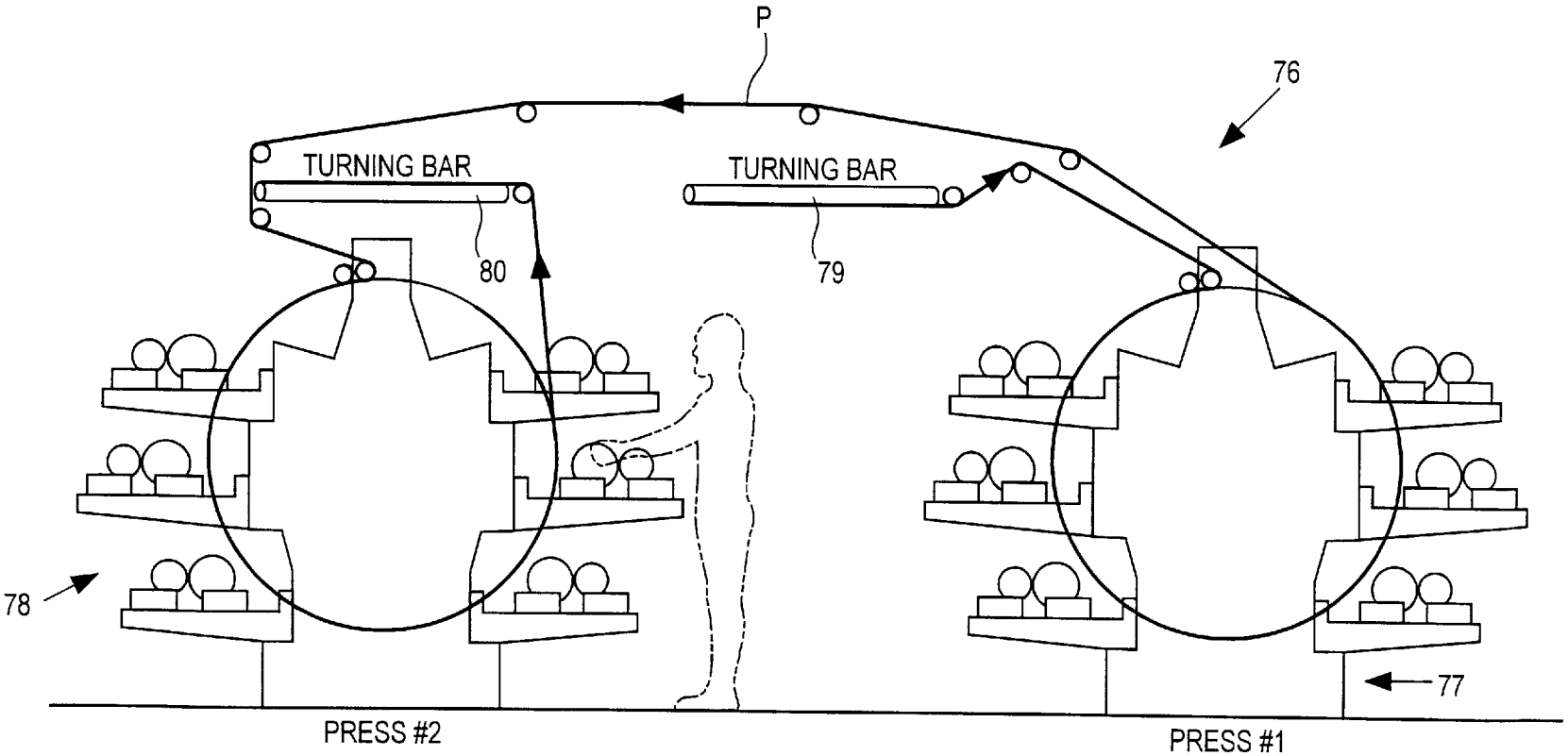
FIG. 4 illustrates another embodiment of a flexographic press formed in accordance with the invention.
Figure 5:
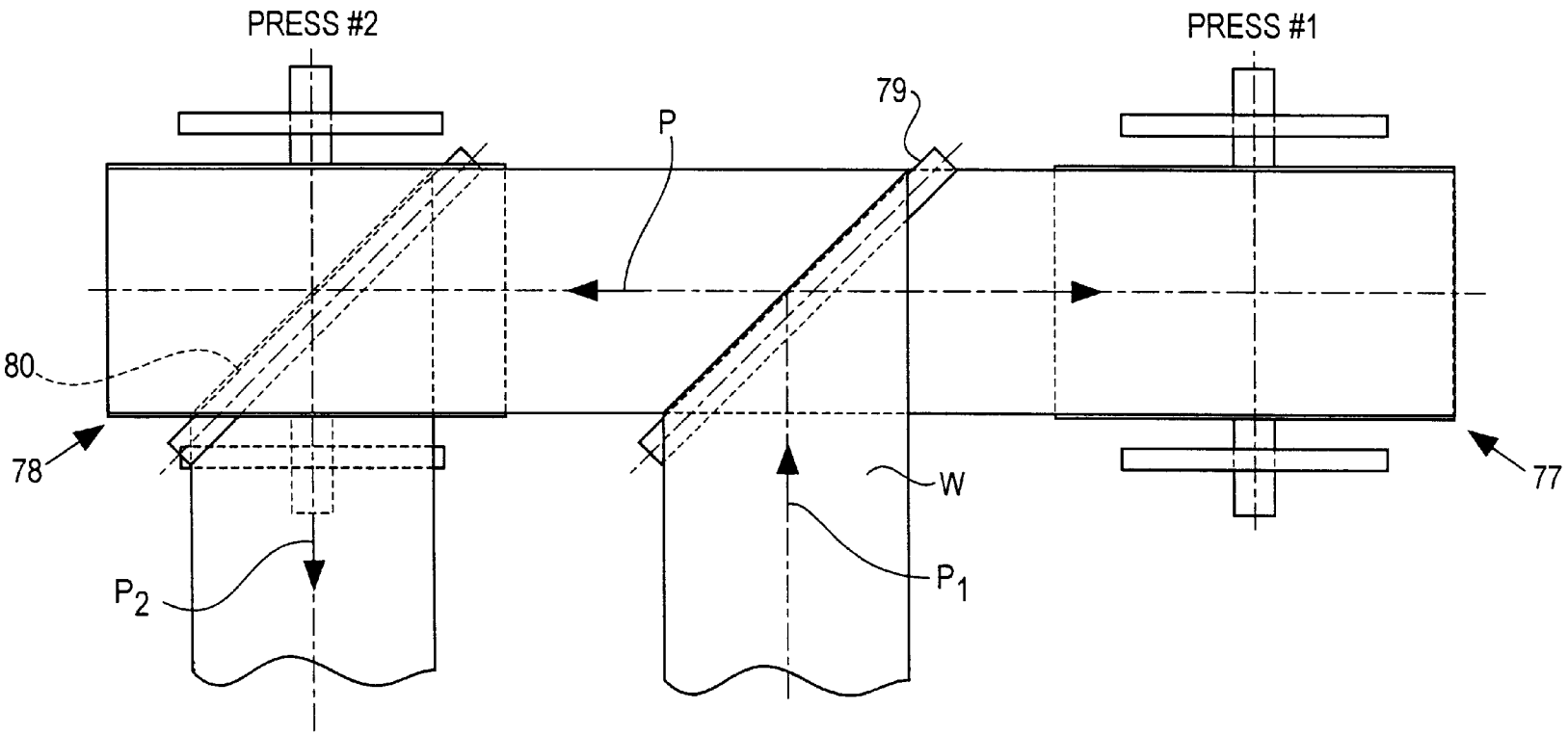
FIG. 5 is a fragmentary top plan view of the press of FIG. 4.

In FIG. 3 the path of web travel between the unwind 66 and the first press section 55 is in the same direction as the path P between the two press sections. FIGS. 4 and 5 illustrate a press 76 which is similar to the press 54 of FIG. 3 except that the web is advanced from the unwind along a path $P_1$ which is perpendicular to the path P between the two press sections 77 and 78 and parallel to the axes of the CI cylinders. The web is turned 90° by a first turning bar 79. After the web is printed by the two press sections, it is turned 90° by a second turning bar 80 and advances along path $P_2$ which is parallel to path $P_1$.

In the embodiment illustrated in FIG. 4, only five idler rolls are used to support the web between the two press sections.

Figure 6:
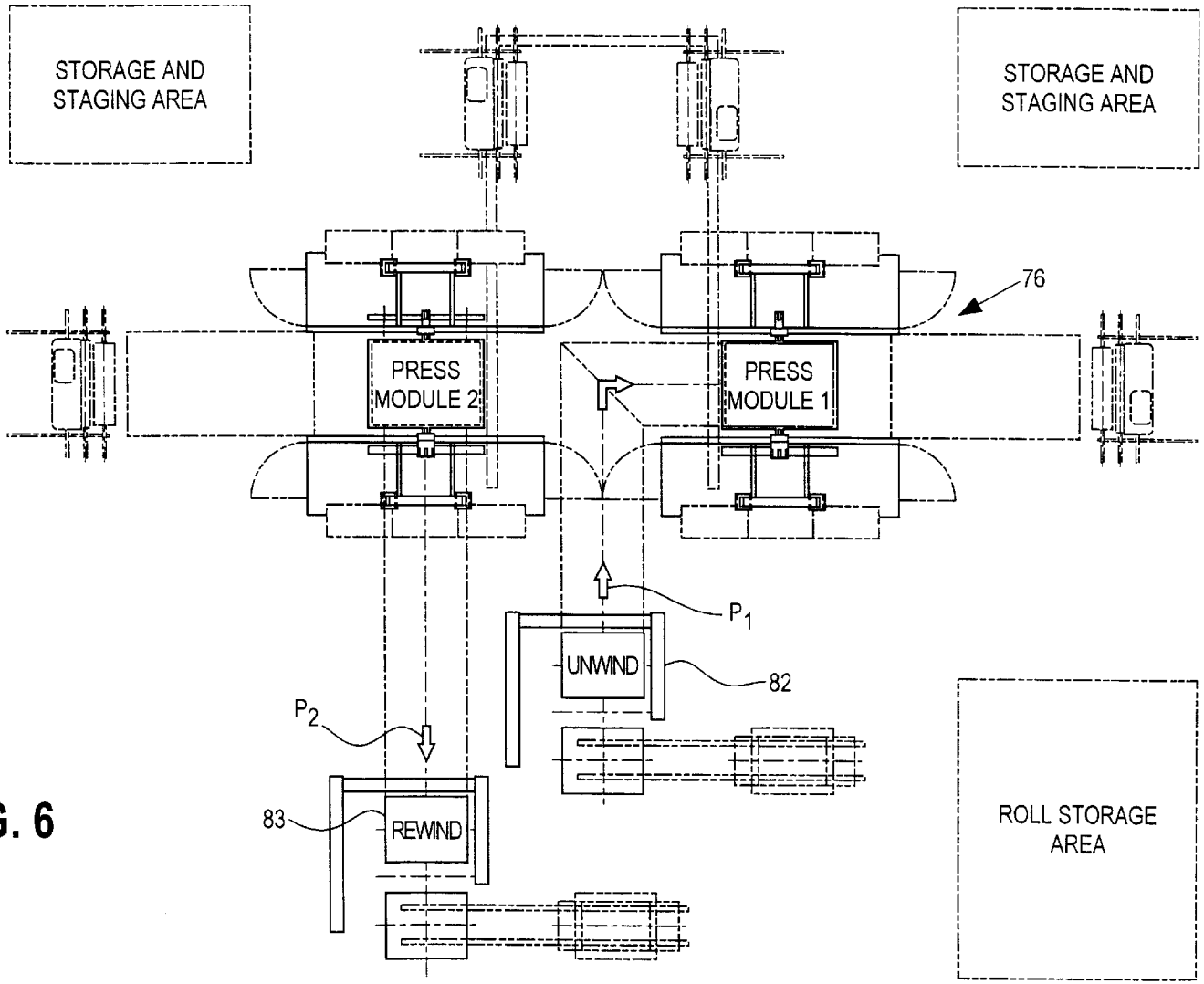
FIG. 6 is a more complete top plan view of the press of FIG. 4.

FIG. 6 is a top view of the press 76, including unwind 82 and rewind 83. The tunnel dryer between the second press section 78 and the rewind 83 is omitted for clarity of illustration.

Figure 7:
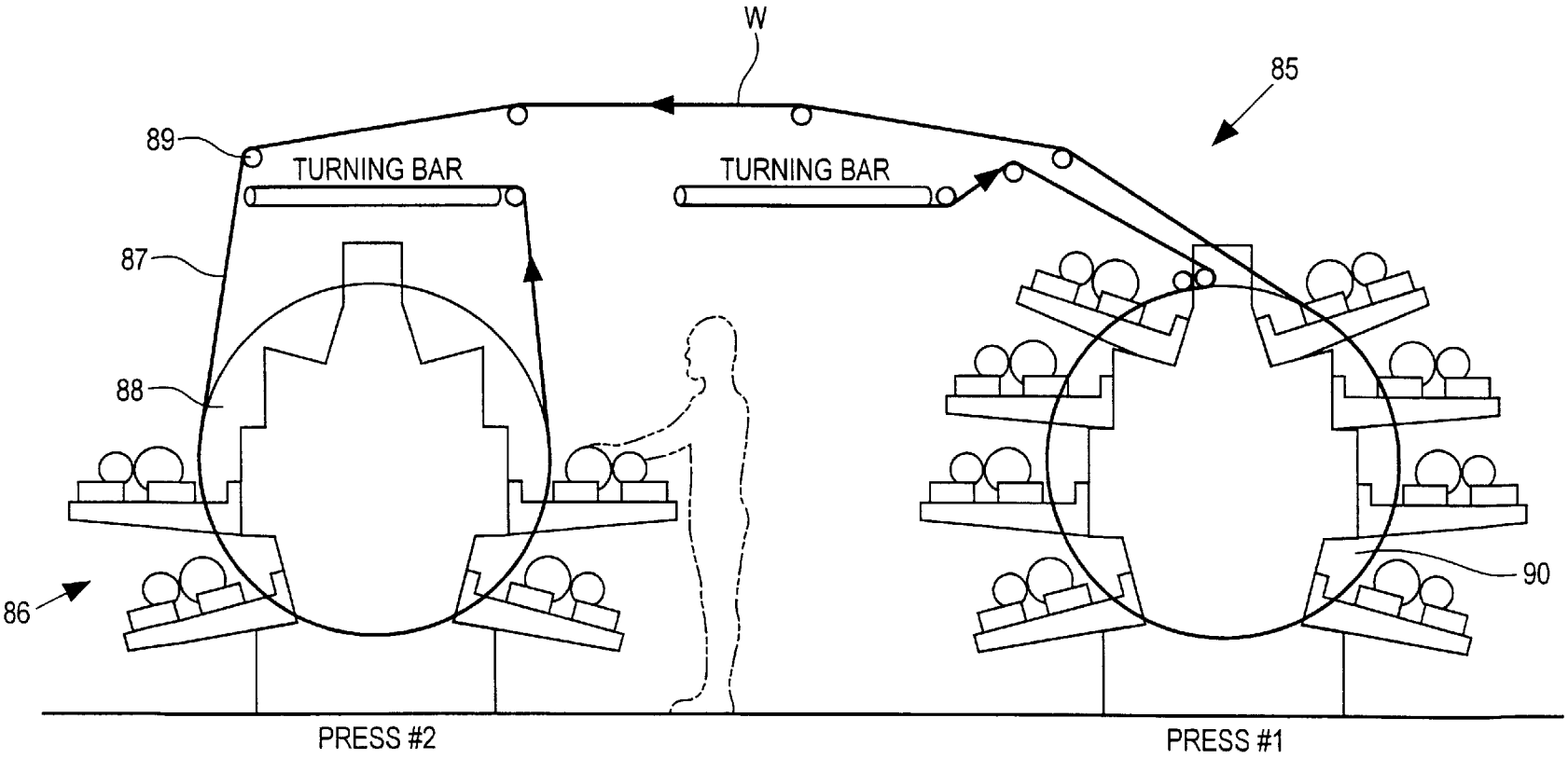
FIG. 7 illustrates another embodiment of a flexographic press formed in accordance with the invention.

FIG. 7 illustrates a press 85 which is similar to the press 76 of FIG. 4 except that the laydown roll is omitted before the second press section 86. The web W travels directly from idler roll 87 to the CI cylinder 88 of the second press. The printed side 89 of the web therefore does not contact any rolls between the first CI cylinder 90 and the second CI cylinder 88. The tangent between the web and the CI cylinder 88 is near the 270° point of the CI cylinder, and the top left color deck of the second press is omitted. The second press of FIG. 7 has only four color decks.

Figure 8:
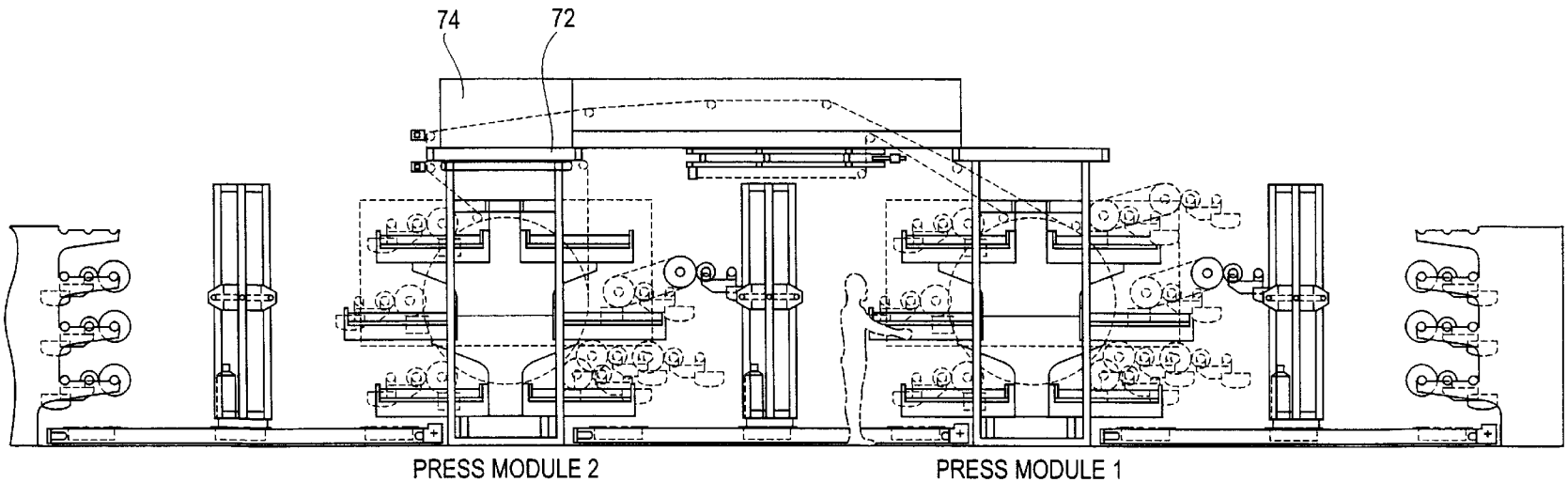
FIG. 8 illustrates the position of a tunnel dryer downstream of the second press section.

FIG. 8 illustrates the position of a tunnel dryer 74 for the press of FIGS. 3–7. The tunnel dryer is located downstream of the turning bar of the second press section and upstream of the rewind or next component of the press Additional flexibility can be designed into the machine by adding bypass web paths around each press section. This allows a six color or less job to be run on one press section while the other press section is set up for the next job. Furthermore, the layout of the machine is designed with designated work areas as shown in FIG. 6. For example, roll handling for both the unwind and rewind are in close proximity to each other while plate and ink handling are on the opposite side of the machine.

Figure 9:
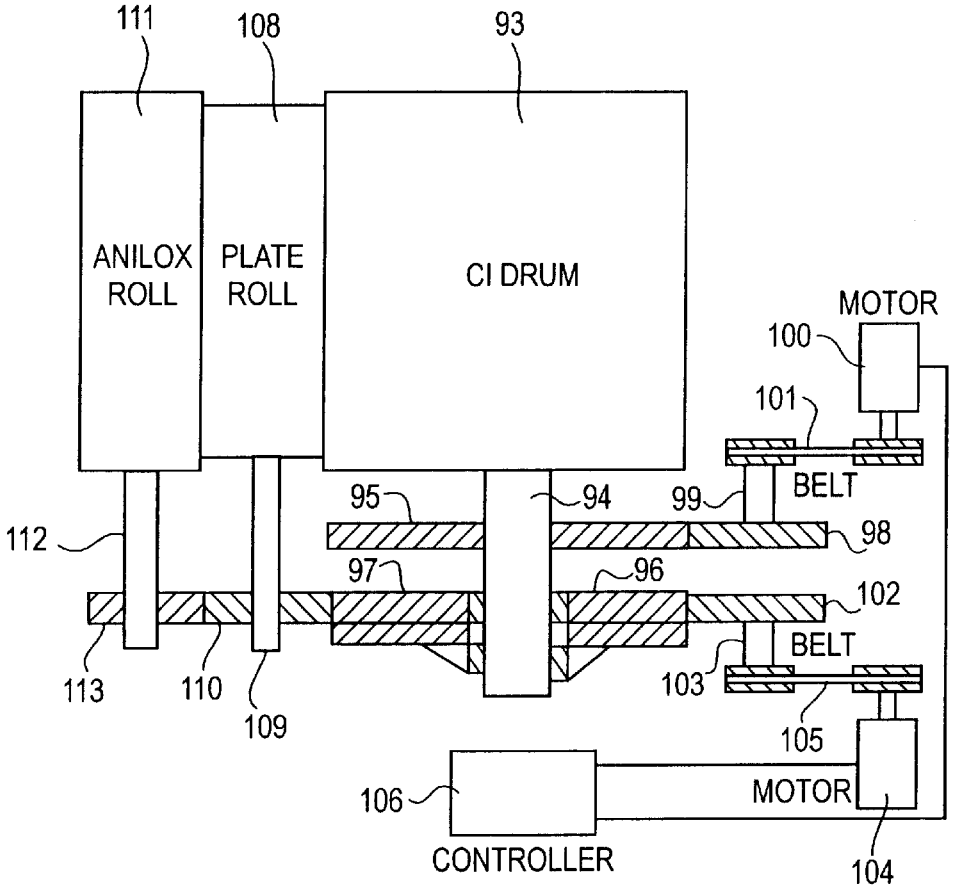
FIG. 9 illustrates one embodiment of a drive system for the CI drum and the plate and anilox rolls for controlling registration and printing repeat lengths that are not a multiple of the format gears.

Referring to FIG. 9, a CI cylinder or drum 93 is mounted on a journal 94. A bull gear 95 is attached to the journal and rotates with the journal and the CI cylinder. The pitch diameter of the bull gear 95 is nearly equal to the diameter of the CI cylinder.

A second bull gear 96 is rotatably mounted on the journal 94 by a bearing 97 so that the gear 96 can rotate independently of the CI cylinder.

The bull gear 95 is driven by a pinion gear 98 which is mounted on a jackshaft 99. A servo motor 100 drives the jackshaft through a drive belt 101.

The bull gear 96 is driven by a pinion gear 102 which is mounted on jackshaft 103. A second servo motor 104 drives the gear 102 through a belt 105.

The two servo motors are controlled by a central motion controller 106 such as a Giddings & Lewis PIC 945.

Plate roll 108 is mounted on plate roll journal 109. Plate roll gear 110 is mounted on the journal and meshes with the bull gear 96.

Anilox roll 111 is mounted on journal 112. Anilox roll gear 113 meshes with the plate roll gear 110, and the anilox roll and plate roll rotate together.

Essentially, the speed of bull gear 95 will follow the speed of the CI cylinder 93. Any variation in the speed to the CI cylinder 93 to adjust tension will also occur in the speed of the bull gear 96 driving the plate roll 108. In addition, register commands from a register system that looks for a mark on the web will be summed with the reference command. The format or plate gears 110 attached to the printing plate rolls, which are located on the various color decks around the CI cylinder 93, are meshed with the plate bull gear 96. Thus, the plate bull gear is responsible for obtaining a tight printing register between the various decks on the press section, similar to a standard CI flexopress.

The motion controller 106 which controls the servo motors 100 and 104 is responsible for the following functions:

a) generation of the line reference position command;

b) in conjunction with the servo drives, closure of the servo loops (current/torque, velocity, and position) for each drive;

c) control of the tension/draw loops between drive sections;

d) control of the registration or phasing command to the plate roll drives for registration;

e) control of the speed offset command to the plate roll drive for variable repeats;

f) discrete logic to control the system.

The first press section in the line is the master of the web control system. This section does not contain any trim signals based upon the web tension, draw, or registration loops. The drive sections prior to and following this section will contain process trim loops. The command for the drum drive will be based upon the line reference position command and any trim based upon the servo loops. The command for the motor that drives the plate rolls will be generated by the repeat length algorithm and any trim associated with its servo loops.

Figure 10:
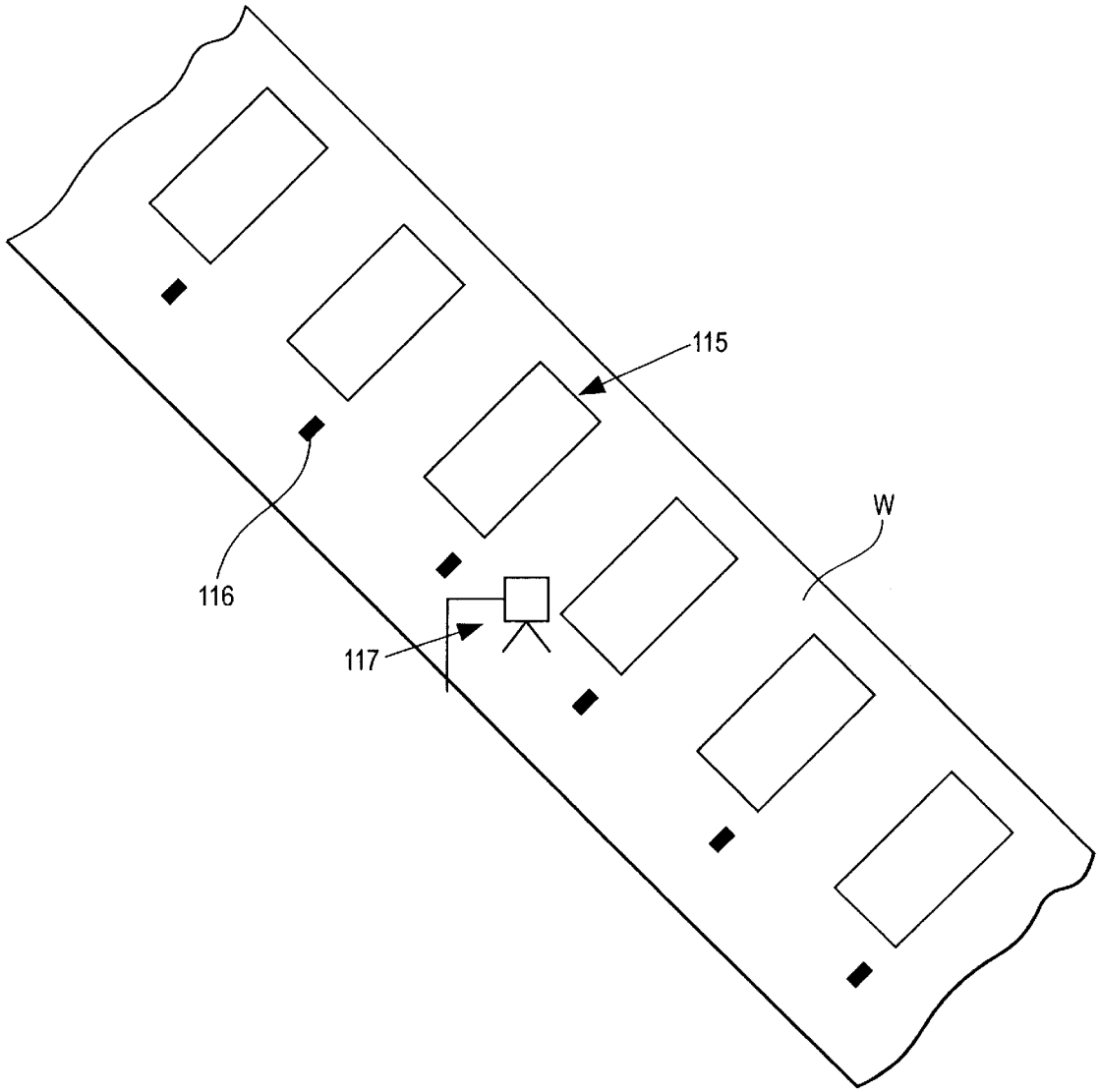
FIG. 10 is a fragmentary perspective view of a printed web with registration marks.

The second press section, in line with the first section, will be registered to the master section. To obtain register, a register controller will be used to determine the amount of register error between the master section and the press section associated with the system. The register system can use either mark-to-cylinder mode or mark-to-mark mode to determine the register error. Referring to FIG. 10, a web W is printed with repeating images 115 and register marks 116. The registration system includes a sensor or register eye 117 which reads the marks on the web. The registration system also requires a feedback signal of actual motion of the press system. This is supplied through an encoder signal. The location of the sensor or register eye is dependent upon the type of mode used. The register system will send a signal to the motion controller indicating the amount of registration error. Based upon the current and previous error signals, the motion controller will generate a command to the servo drive controlling the motor for the plate rolls. The correction command will cause a phase shift between the plate cylinders and the CI cylinder web. Because the nature of flexographic printing is essentially a kiss or a light impression process, the plate can slip across the web.

A control unit that measures registration error between two printed colors is considered an integral component of this machine. The register control is part of the process loop which provide the outermost loop in the control scheme. The other inner loops of the control scheme include the position loop, velocity loop, and the current/torque loop. A design emphasis has been placed on reduction of possible register error. The register system will be used to compensate for the final amount of register error that could not be eliminated. With the register system operating under steady state conditions, the final register error is not larger than 0.009 inch.

The command to the drive for the CI cylinder will be a combination of the line speed reference and the tension or draw trim, depending upon the mode that is selected. A draw trim will produce a position offset in relation to the preceding machine section. In other words, the incremental position command of the downstream impression cylinder will be greater than that of the preceding impression cylinder. However, the amount of web that passes the nip of the first impression cylinder will be the same as the amount of web that passes the nip of the downstream impression cylinder during the same period. The tension trim signal will be based upon the tension loop for the web section prior to the press. The purpose of the tension loop will be to match the tension of the web going into the press section with the tension of the web going into the master press section. Furthermore, the control system will have the capability to detect a constant registration error and produce a command signal to the plate roll drive.

The register system will also accomplish more than just maintaining print register. It will also be used to automatically obtain register. Each printing deck will print a predefined mark. The sequence of marks will be defined so that the register system can determine the register error as soon as the printed marks can be sensed by the system. Not only will the system significantly reduce mark ready time, it will also lessen the burden on the operator.

All the press sections will have the capability to print a repeat that is not a multiple of the format gear or in other words a variable repeat. The system is able to do this by commanding the plate roll bull gear 96 to constantly rotate at a different ratio relative to the reference than the bull gear 95 of the CI cylinder. The ratio is determined by measuring the circumferential distance traveled by the bull gears divided by the distance the reference has moved. Depending upon the plate roll size, the speed variation will either cause the plate to slip across the web or match the speed of the CI cylinder. If the plate roll is constantly slipped over the web, the length of the printed image will be dependent upon the differential between the two commanded ratios. If the plate roll has traveled further than the web on the CI cylinder during the same update, the printed image will be shorter than the plate. Likewise, if the distance traveled by the plate roll is smaller than the distance the web is traveled, then the image will be longer.

The difference or offset in ratios will be limited in this method. The slurring of the print will effect the quality of the print as the offset becomes larger. To obtain high quality print, the design of the plate may need to be adjusted to compensate in the circumferential direction for slurring. The other option will be to compensate for the difference in distance traveled by adjusting the plate roll circumference to match the desired print length. The format gear would still be a multiple of the phasing gear, but the plate roll circumference would not. In this manner, the circumferential distance the plate roll travels would match the distance the web has traveled, even though the surface speed of the format gear would not match. The gear configuration will, most likely, need to be changed to allow circumferential registration adjustment.

Finally, this system will also be used in automatically meshing the plate roll gear with the CI gear. Currently, the entire machine line is indexed during the meshing sequence. The material that is used during this function is considered waste. With this system, only the plate roll bull gear 96 needs to be rotated during the gear mesh sequence. Thus the CI cylinder does not rotate, and the material is not wasted.

There are other designs for rotating the CI cylinder, plate rolls, and anilox rolls. For example, each component could incorporate a separate servo drive. This type of configuration would eliminate a plurality of gears and drive mechanism used in the described drive train. Ultimately, the drive train design affects the ability of the system to maintain tight registration tolerances. Anyone skilled in the art would be able to modify the drive train components without affecting the overall invention. The effect of any modification would be seen in the registration quality of the printed product.

Figure 11:
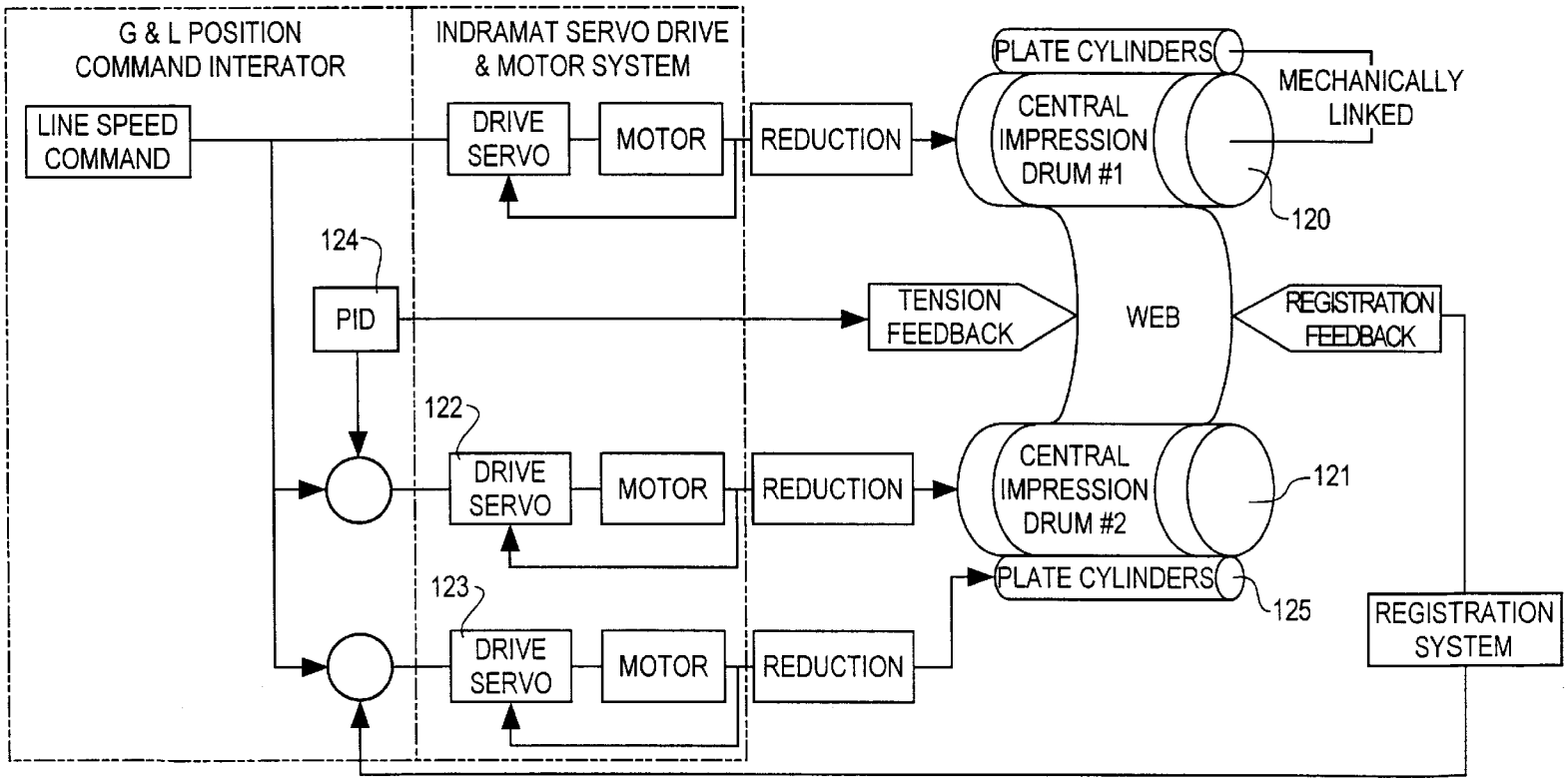
FIG. 11 is a block diagram of the drive system of the press.

Referring to FIG. 11, a press includes first and second CI drums 120 and 121. The second press section is controlled by two servo drives 122 and 123. The first servo drive 122 contains a belt drive to a jackshaft (see 101 and 99 in FIG. 9). A pinion gear (see 98 in FIG. 9), which mounts to this jackshaft, meshes with a bull gear (see 95 in FIG. 9) that is mounted on the journal of CI 121. The object of this servo is to drive the press section at line speed. Included in the command of this drive for the second press section will be the trim offset from tension control loop 124. The first press section is considered to be the master section in the mass flow analysis of the web.

The second servo drive 123 on the second press section is used to drive the plate roll 125 and anilox roll. This motor is also belt driven to a jackshaft (see 103 in FIG. 9) which meshes with a bull gear (see 98 in FIG. 9). This bull gear is mounted on a set of bearings (see 97 in FIG. 9) around the journal of the CI cylinder 121. The bearings isolate the motion of the plate rolls with respect to the CI cylinder. A dual set of bearings may be used to give stability and improve alignment of the system. This system will be used in the control of the registration and the ability of the system to print repeat lengths that are not a multiple of the format gears. This design will have the flexibility to print variable repeat lengths. It will also have an option to add a ring gear to the bull gear that drives the plate rolls so that a second "standard" pitch can be used.

The vendor equipment used in this design can be obtained from a number of sources. The specific components that are used in this description include:

a) motion controller such as Giddings & Lewis PIC945;

b) registration system such as a Eltromat DRC 200;

c) servo motors and amplifiers such as an Indramat DDS system;

d) web guided turn bar unit obtained from BST.

This flexographic press is unique in its ability to print up to 11 colors on an extensible web while holding tight registration tolerances expected from a CI press and giving greater operator access compared to other CI flexopresses. Having the design capable of printing variable repeats adds to the flexiblity of this machine.

Some of the benefits to this system are the following:

1. In line CI concept allows more colors to be printed without the possibility of reduced repeat range and without the possibility of transferring ink from the printed web onto idler rolls before the ink is dry.
2. Machine design obtains a low height profile for convenient operator access and increased level of safety. It also allows the machine to fit into plants with low ceilings.
3. Ability to group colors, especially process colors, of a print job under tight register conditions on a single press.

4. Ability to run a six or less color job on one press while a second five color or less job is being safely set up on the other press.
5. High quality web handling. The web tension is controlled between the press sections without affecting the registration.
6. Process control without affecting drying. The system can compensate for web stretch or shrinkage without adjusting the dryer temperature.
7. Material savings during automatic gear mesh will reduce waste costs.
8. Short web path between print sections minimizes web disturbances, which play a key role in registration accuracy.
9. Machine layout provides ergonomic work centers for specific operator tasks.
10. Print repeats are not limited to gear pitch.
11. Potential for reduced plate roll inventory. By being able to run the plate roll slightly faster or slower than the web, different repeats are achieved without the cost of having exact sized plate rolls.
12. Automatic register controls for decks that are not linked through a single CI cylinder.

Either water based inks, solvent based inks, or ultraviolet (U.V.) inks can be used. If U.V. inks are used, the dryers are replaced with devices for supplying U.V. radiation for curing the ink.

Although the specific embodiment described herein is a flexographic press, the invention can also be used with other presses, for example, gravure presses.

While in the foregoing specification a detailed description of specific embodiments of the invention was set forth for the purpose of illustration, it will be understood that many of the details herein given can be varied considerably by those skilled in the art without departing from the spirit and scope of the invention.

We claim:

1. A printing press comprising:

first and second central impression cylinders, each of the central impression cylinders having an axis of rotation, the axes of rotation extending parallel to each other, means associated with the first central impression cylinder for printing one side of a web while an unprinted side of the web contacts the first central impression cylinder, means for advancing a web between the first and second central impression cylinders in a direction which extends generally perpendicularly to said axis of rotation, said means for advancing a web between the first and second central impression cylinders being adapted to contact only the unprinted side of the web, means for advancing a web between the second central impression cylinder and equipment downstream of the second central impression cylinder in a direction which extends generally parallel to said axes of rotation, and a laydown roll adjacent the second central impression cylinder which is adapted to contact the printed side of the web and direct the web to the second central impression cylinder.

2. The press of claim 1 in which the press does not include a device for drying or curing ink between the first and second central impression cylinder.

3. A printing press comprising:

first and second central impression cylinders, each of the central impression cylinders having an axis of rotation, the axes of rotation extending parallel to each other, means for advancing a web between the first and second central impression cylinders in a direction which extends generally perpendicularly to said axes of rotation, means for advancing a web between the second central impression cylinder and equipment downstream of the second central impression cylinder in a direction which extends generally parallel to said axes of rotation, and a plurality of plate rolls and anilox rolls mounted adjacent to the first central impression cylinder, a journal attached to the first central impression cylinder on the axis of rotation, a first bull gear mounted on the journal for rotation therewith, a first pinion gear meshing with the first bull gear, a first servo motor for driving the first pinion gear, a second bull gear rotatably mounted on the journal, a plate roll gear mounted on each of the plate rolls and meshing with the second bull gear, a second pinion gear meshing with the second bull gear, and a second servo motor for driving the second pinion gear and thereby driving the plate roll gears through the second bull gear.

4. The press of claim 3 including control means for controlling each of the servo motors and for causing a phase shift between the plate rolls and the central impression cylinder.

5. A printing press comprising:

first and second central impression cylinders, each of the central impression cylinders having an axis of rotation, the axes of rotation extending parallel to each other, means associated with the first central impression cylinder for printing one side of a web while an unprinted side of the web contacts the first central impression cylinder, and means for advancing a web between the second central impression cylinder and equipment downstream of the second central impression cylinder in a direction which extends generally parallel to said axes of rotation, said means for advancing a web being adapted to contact only the unprinted side of the web, and a laydown roll adjacent the second central impression cylinder which is adapted to contact the printed side of the web and direct the web to the second central impression cylinder.

6. The press of claim 5 in which the press does not include a device for drying or curing ink between the first and second central impression cylinders.

7. A printing press comprising:

first and second central impression cylinders, each of the central impression cylinders having an axis of rotation, the axes of rotation extending parallel to each other, means associated with the first central impression cylinder for printing one side of a web while an unprinted side of the web contacts the first central impression cylinder, and means for advancing a web between the second central impression cylinder and equipment downstream of the second central impression cylinder in a direction which extends generally parallel to said axes of rotation, said means for advancing a web being adapted to contact only the unprinted side of the web, and a plurality of plate rolls and anilox rolls mounted adjacent to the first central impression cylinder, a journal attached to the first central impression cylinder on the axis of rotation, a first bull gear mounted on the journal for rotation therewith, a first pinion gear meshing with the first bull gear, a first servo motor for driving the first pinion gear, a second bull gear rotatably mounted on the journal, a plate roll gear mounted on each of the plate rolls and meshing with the second bull gear, a second pinion gear meshing with the second bull gear, and a second servo motor for driving the second pinion gear and thereby driving the plate roll gears through the second bull gear.

8. The press of claim 7 including control means for controlling each of the servo motors and for causing a phase shift between the plate rolls and the central impression cylinder.

* * * * *